United States Patent [19]

Hlousek

[11] Patent Number: 4,843,760

[45] Date of Patent: Jul. 4, 1989

[54] CROSSED-ARM WINDOW LIFTER, ESPECIALLY FOR MOTOR VEHICLES

[75] Inventor: Peter Hlousek, Coburg, Fed. Rep. of Germany

[73] Assignee: Brose Fahzeugteile GmbH & Co., KG, Fed. Rep. of Germany

[21] Appl. No.: 66,503

[22] Filed: Jun. 26, 1987

[51] Int. Cl.[4] ..... E05F 11/46

[52] U.S. Cl. ..... 49/351; 403/164

[58] Field of Search ..... 49/351, 350, 374, 349; 403/164; 384/275, 424

[56] References Cited

U.S. PATENT DOCUMENTS

| | | | |
|---|---|---|---|
| 2,010,075 | 8/1935 | Graf | 49/351 |
| 2,696,018 | 12/1954 | Hollister | 403/164 |
| 3,231,301 | 1/1966 | Gray | 49/351 |
| 3,897,652 | 8/1975 | Hess | 49/351 |

FOREIGN PATENT DOCUMENTS

| | | | |
|---|---|---|---|
| 2321185 | 5/1974 | Fed. Rep. of Germany . | |
| 8032825 | 3/1981 | Fed. Rep. of Germany . | |
| 3130520 | 3/1983 | Fed. Rep. of Germany . | |
| 2307945 | 12/1976 | France | 49/351 |
| 8705070 | 8/1987 | PCT Int'l Appl. | 49/140 |

*Primary Examiner*—Kenneth J. Dorner
*Assistant Examiner*—Gerald A. Anderson
*Attorney, Agent, or Firm*—Barnes & Thornburg

[57] ABSTRACT

A crossed-arm window lifter for motor vehicles comprises a primary arm pivotably mounted on a carrier and a secondary arm (30) mounted on the primary arm by a crossed-arm pivot joint 38. The primary arm is divided into two arm parts 26 and 32. The arm part 26 next to the carrier comprises a stamped portion 48 with a height d which corresponds to the sheet metal thickness b of the secondary arm 30 in the region of a bearing opening 44 surrounding the stamped portion 48. The arm part 32 remote from the carrier is rigidly secured to the end face of the stamped portion 48.

9 Claims, 1 Drawing Sheet

CROSSED-ARM WINDOW LIFTER, ESPECIALLY FOR MOTOR VEHICLES

FIELD OF THE INVENTION

The invention relates to a crossed-arm window lifter, especially for motor vehicles, having a primary arm pivotably mounted on a carrier, possibly a base plate, and acting with one arm end on a window pane, and having a secondary arm of double-arm form retained on the primary arm by a crossed-arm pivot joint, of which secondary arm one arm end engages with the window pane and the other arm end engages with a longitudinal guide, possibly an auxiliary rail, fast with the carrier, one of the arms being divided in the pivot joint region into two arm parts with a stamped portion on one of the arm parts which passes through a bearing opening of the other arm, for the swivel mounting of the other arm on the external circumference of the stamped portion, and which is rigidly secured by the end face to the other arm part, possibly by spot welding.

DESCRIPTION OF THE PRIOR ART

In a known crossed-arm window lifter of this kind (German published Application No. 2,321,185) the primary arm is made in one piece over its entire length, that is in the region between the pivot bearing on the carrier and the point of action upon the window pane. On the other hand the secondary arm is divided into two arm parts. A stamped portion of the one arm part engages from one side and a stamped portion of the other arm part of the secondary arm engages from the other side in a bearing opening of the primary arm. The two stamped portions are spot-welded or riveted with one another. The height of each stamped portion thus corresponds to half the thickness of the primary arm (that is half the sheet metal thickness of the primary arm in the case of a pressed sheet metal primary arm). The division of the secondary arm into two arm parts with the primary arm arranged between the two arm parts offers the possibility of pivoting the primary arm through beyond the parallel position of the two arms in both directions.

It is disadvantagous in this known arrangement that a reduction of the arm thickness or sheet metal thickness of the two arm parts of the secondary arm, possible per se in many cases from the stand point of mechanical stability is limited since the necessary height of a stamped portion with cylindrical outer circumference must not be greater than a maximum of $\frac{2}{3}$ of the arm thickness or sheet metal thickness of the respective arm part. With an arm thickness of the primary arm for example of 1.8 mm the secondary arm, taking account of the requisite joint play, must have an minimum arm thickness of at least 1.5 mm. Moreover increased manufacturing inaccuracies arise, since the production errors of the two push-through swaging operations are cumulative.

It is also known from German Utility Model No. 8,032,825 to make the primary arm in one piece and to divide the secondary arm into two arm parts. The connection of these two arm parts is effected by a punched-out bearing opening in the one arm part and an embossed collar formed on the other arm part and engaging behind said opening. Here again the manufacturing inaccuracies of the swagings of the two arm parts are cumulative. The punched-out openings in the two arm parts can result in a weakening of these parts. German published Application No. 3,130,520 again shows a crossed-arm window lifter with primary arm made in one piece. The two arm parts of the secondary arm are connected with one another through an additional part in the form of a circular disc inserted into the bearing opening of the primary arm. This additional part, to be produced with high manufacturing accuracy, increases the production costs of the crossed-arm window lifter, a mass product.

SUMMARY OF THE INVENTION

An object of the invention is to provide a crossed-arm window lifter which can be produced with increased manufacturing accuracy and renders possible a reduction of material thickness of the secondary arm and of the part of the primary arm remote from the carrier.

For this aim the primary arm is divided into two arm parts and the arm part of the primary arm on the carrier side comprises the stamped portion with a height which corresponds to or slightly exceeds the thickness of the secondary arm in the region of the bearing opening. The other part of the primary arm lies flat on the stamped portion.

According to the invention the stamped portion is to be provided only on a single part namely on the part next to the carrier of the primary arm, which is sufficiently thick from the outset, since this arm part is to be provided for the entire loading. While in the known window lifter as initially mentioned it is to be ensured not only that the two stamped portions have exactly equal dimensions, but also that they are welded or riveted with one another in exact alignment in order to ensure for the one part easy motion and for the other high durability of the crossed-arm pivot joint, in the arrangement according to the invention attention must be given only to the maintenance of the dimensions of one single stamped portion in the manufacture. A separate swaging action for the production of the stamped portion is not necessary, since the arm part must in almost any case be provided with stiffening swagings, for example stiffening corrugations or bent-over longitudinal edges, to increase the mechanical strength with minimum possible arm thickness. The part of the primary arm remote from the carrier part is merely to be provided with a flat circular assembly surface which, after the fitting of the continuous one-piece secondary arm, provided with the bearing opening, on to the stamped portion of the arm part on the carrier side, is to be welded or riveted to the end face of this stamped portion. The assembly surface here protrudes radially beyond the circumference of the stamped portion and forms an annular flat abutment face for the continuous one-piece secondary arm inserted between the two arm parts. The lower limit for the thickness of the secondary arm is now dependent exclusively upon the magnitude of the forces acting upon the secondary arm and thus can readily be reduced to 1.2 mm or less for example, with an unchanged arm thickness of the carrier-side part of the primary arm of 1.8 mm. The consequence is a corresponding reduction of the production costs and of the window lifter weight. A further advantage of the arrangement according to the invention consists in that the arm thickness of the part of the primary arm remote from the carrier is now independent of the thickness of the carrier-side arm part. Since the arm part remote from the carrier has to take up only about $\frac{1}{3}$ of the forces of the arm part on the carrier side, it can be made with correspondingly reduced arm thickness (for example 1.2 mm), which again results in reduced material consumption and reduced weight.

Production is further simplified in that the part of the primary arm remote from the carrier has substantially the same arm thickness as the secondary arm.

It is especially advantageous if the thickness of the part of the primary arm close to the carrier amounts to about 1.5 times, preferably about 1.7 times, the thickness of the secondary arm.

In order to guarantee a reliable long-term lubrication of the crossed-arm pivot joint, with simple production, it is proposed that the secondary arm is provided on at least one of the two sides, each facing one of the arm parts, with a small bearing region provided with grease pockets around the bearing opening.

BRIEF DESCRIPTION OF THE DRAWINGS

The invention will be explained hereinafter by reference to a preferred example of embodiment shown in the drawing, wherein.

DESCRIPTION OF THE PREFERRED EMBODIMENT

Figure 1:
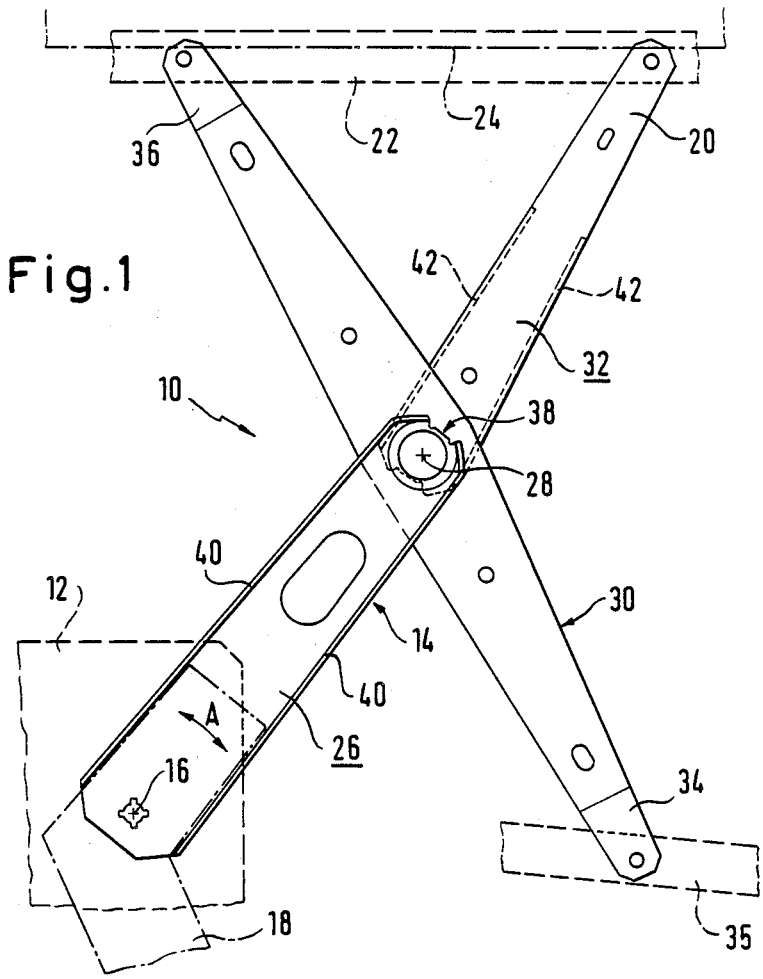
FIG. 1 shows a greatly simplified lateral view of the crossed-arm of a motor vehicle window lifter and FIG. 2 shows an enlarged exploded sectional view of the crossed-arm according to FIG. 1 in the region of the crossed-arm pivot joint.

In FIG. 1 there is illustrated a crossed-arm 10 of a motor vehicle window lifter which is otherwide ordinary and therefore omitted in the FIG. One merely sees in chain lines a carrier 12, possibly a base plate, for a window lifter drive system which can be made for actuation manually and/or by a motor, especially an electric motor. The two-part primary arm 14 is mounted pivotably, as indicated by a pivot axis 16, on the carrier 12. The primary arm 14 is rigidly connected with a toothed segment 18, which is represented broken away in FIG. 1 (dot-and-dash line). This toothed segment 18 is driven by a drive pinion (not shown) being part of the manually or motor driven actuating system (not shown) so that the primary arm 14 can be pivoted in the direction of the double arrow A in FIG. 1. The primary arm 14, in departure from the example of embodiment as illustrated, may also be made in one piece with the toothed segment 18.

The free arm end 20, remote from the axis 16, of the primary arm 14 engages with a lifting rail 22, indicated in chain lines, on the lower edge 24, indicated with a dot-and-dash line in FIG. 1, of the window pane to be lifted.

The primary arm 14 is divided into two arm parts, namely a carrier-side arm part 26 between the pivot joint (axis 16) on the carrier 12 and a crossed-arm pivot joint (pivot axis 28) by which a one-piece secondary arm 30 is mounted on the primary arm 14, and an arm part 32 remote from the carrier, which extends between the crossed-arm pivot joint (axis 28) and the lifting rail 22. The length of arm part 26 is nearly the same as the length of arm part 32.

The secondary arm 30 is made as an extended double arm, the one end 34 of which is guided on a longitudinal guide 35 fast with the carrier and the other arm end 36 of which acts on the lifting rail 22 of the window pane. The longitudinal guide 35 can be formed for example by a rail of C-section in which there engages a guide roller mounted on the arm end 34; other forms of embodiment are also conceivable, for example the formation of the longitudinal guide 35 as a slot in a component fast with a vehicle door. In place of a guide roller a slide block or the like may also be considered. Correspondingly the upper arm ends 20 and 36 are also coupled in the usual way with the lifting rail 22.

Figure 2:
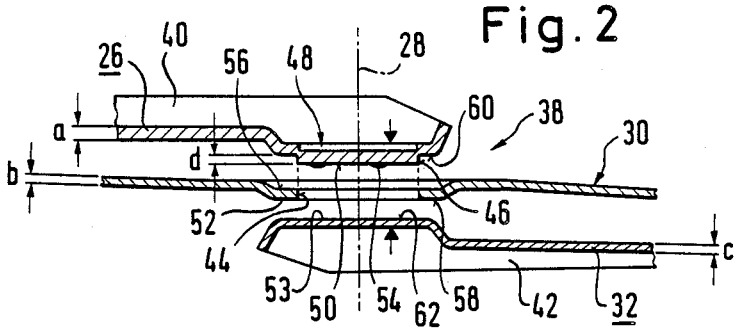

The already mentioned crossed-arm pivot joint 38 which fixes the pivot axis 28 fast with the primary arm will be explained in greater detail below by reference to the exploded sectional representation in FIG. 2.

The arm part 26 on the carrier side, like the arm part 32 remote from the carrier and the secondary arm 30, is made as a swaged sheet metal part, however, with a greater arm thickness (sheet metal thickness) a of 2 mm compared with the arm thickness (sheet metal thickness) b of the secondary arm 30 of 1.25 mm, corresponding to the arm part 32 with an arm thickness (sheet metal thickness) c of likewise 1.25 mm. To increase the mechanical strength of the arm part 26 its longitudinal edges 40 are bent over at right angles. Correspondingly in the arm part 32 too the longitudinal edges 42 are bent over at right angles over a part of their length.

For the formation of the pivot joint 38 the secondary arm 30 is provided in the region of the middle of its length with a circular bearing opening 44 which, when the crossed-arm 10 is in the assembled condition, is pivotably mounted on the external circumference 46 of a stamped portion 48 swaged on the arm part 26. The stamping height d, that is the axial length of the cylindrical external circumference 46, is 1.3 mm and corresponds to about the arm thickness b of the secondary arm 30. The essential plane end face 50, lying downwards in FIG. 2, of the stamped portion 48 therefore in the assembled condition protrudes slightly beyond the under side 52 of the secondary arm 30 in the region of the bearing opening 44. If therefore the arm part 32 remote from the carrier is rigidly secured to the arm part 26 with a flat assembly surface 53 lying flat on the end face 50, whether by spot welding (in FIG. 2 two of a total of three weld humps 54 are indicated on the end face 50) or by riveting or the like, then a slight but sufficient axial bearing play of the secondary arm 30 results between the two arm parts 26 and 32 of the primary arm 14.

The secondary arm 30 is provided on each of its two sides, all round the bearing opening 44, with an annular bearing region 56 and 58 provided with grease pockets, which regions rest each on a corresponding annular bearing region 60 of the arm part 26 and 62 of the arm part 32 (areas of the assembly surface 53) and by reason of the permanent lubrication ensure low-friction and low-wear pivot mounting of the secondary arm 30 on the primary arm 14.

The stamped portion 48 is produced in the ordinary way by stamping in that a circular-cylindrical punch (male stamp) with a punch diameter (for example 21 mm) corresponding to or slightly exceeding the external diameter of the stamped portion 48 (=external diameter of the external circumference 46, for example 20 mm) is forced into the sheet metal material of the arm part 26 lying on a punch bottom die (female stamp) which is arranged concentrically with the punch and possesses a cylindrical through-passing bore with a bore diameter corresponding to the external diameter of the stamped portion 48 with a punch depth which corresponds to the height d of the stamped portion 48. The weld humps 54 may also be formed in the swaging of the stamped portion 48. The "terminus technicus" in German language for such a stamped portion is "Durchstellung".

I claim:

1. A crossed-arm window lifter, especially for motor vehicles, comprising:

a carrier (12);

an elongated driven lifter primary arm (14) a first primary arm end of said primary arm being pivotably mounted on said carrier by a pivot bearing (16) and a second primary arm end (20) acting on a window pane;

an elongated secondary arm (30) being pivotably mounted on the primary arm by a crossed-arm pivot join (38), said pivot joint being arranged between the first and second primary arm ends of the primary arm and between first and second secondary arm ends of the secondary arm, the first secondary arm end (36) of the secondary arm (30) acting on the window pane and the secondary second arm end of the secondary arm (34) acting on a longitudinal guide (35) being rigidly connected with the carrier (12);

wherein said primary arm is divided into two separate arm parts, the first arm part (26) having a first arm thickness (2) and extending between said first primary arm end and said pivot joint and a second arm part (32) having a second arm thickness (c) and extending between said pivot joint and said second primary arm end of said primary arm the first arm thickness (2) being greater than the second arm thickness (c);

wherein said first arm part (26) is provided with a stamped portion (48) with a cylindrical outer circumference (46) extending between a side face of the first arm surrounding said stamped portion (48) and an end face (50) of said stamped portion (48), said end face being parallel to said side face, said stamped portion having a portion height (d), which corresponds to or slightly exceeds the arm thickness (b) of the secondary arm (30) in the region of the pivot joint, said stamped portion (48) extending through a bearing opening (44) provided in said second arm (30), the diameter of said bearing opening being adapted to the diameter of the outer circumference (46) of the stamped portion (48) for pivotal mounting of the secondary arm (30) on said stamped portion (48) and wherein the second arm portion (32) has a flat mounting surface (53) lying flat on said end face (56) of said stamped portion (48) and wherein said first arm portion (26) and said second arm portion (32) are fastened together in the regions of said mounting face and said end face.

2. A crossed-arm window lifter as claimed in claim 1, wherein the second arm part (32) has substantially the same arm thickness (c) as the secondary arm (30).

3. A crossed-arm window lifter as claimed in claim 1, wherein the arm thickness (2) of the first arm part (26) amounts to about 1.5 times the arm thickness (b) of the secondary arm (30).

4. A crossed-arm window lifter as claimed in claim 1, wherein the arm thickness (2) of the first arm part (26) amounts to about 1.7 times the arm thickness (b) of the secondary arm (30).

5. A crossed-arm window lifter as claimed in claim 1, wherein the secondary arm (30) is provided, around the bearing opening (44), on at least one of the two sides each facing one of the first and second arm parts, with a small bearing zone (56, 58) provided with grease pockets.

6. A crossed-arm window lifter, especially for motor vehicles, comprising:

a carrier;

an elongated driven primary arm, a first primary arm end of said primary arm being pivotably mounted on said carrier by a pivot bearing and a secondary primary arm end of the first primary arm acting on a window pane;

an elongated secondary arm having a thickness of (b) and being pivotably mounted on the primary arm by a crossed-arm pivot joint, said pivot joint being arranged between the first and second primary arm ends of the primary arm and between a first secondary arm end of the secondary arm acting on the window pane and a second secondary arm end of the secondary arm acting on a longitudinal guide being rigidly connected with the carrier;

wherein said primary arm being divided into two separate arm parts, a first arm part having a first arm thickness (a) extending between said first primary arm end and said pivot joint and a second arm part extending between said pivot joint and said second primary arm end of said primary arm, said first arm thickness (a) being about 1.5 times the thickness of said secondary arm thickness (b);

wherein said first arm part is provided with a stamped portion with a cylindrical outer circumference extending between a side face of the first arm surrounding said stamped portion and an end face (50) of said stamped portion, said end face being parallel to said side face, said stamped portion having a portion height (d), which corresponds to or slightly exceeds the arm thickness (b) of the secondary arm in the region of the pivot joint, said stamped portion extending through a bearing opening provided in said secondary arm, the diameter of said bearing opening being adapted to the diameter of the outer circumference of the stamped portion for pivotal mounting of the secondary arm on said stamped portion and wherein the second arm portion has a flat mounting surface lying flat on said end face of said stamped portion and wherein said first arm portion and said second arm portion are fastened together in the regions of said mounting face and said end face.

7. A crossed-arm window lifter as claimed in claim 6, wherein the secondary arm is provided around the bearing opening, on at least one of the two sides each facing one of the first and second arm parts, with a small bearing zone provided with grease pockets.

8. A crossed-arm window lifter, especially for motor vehicles, comprising:

a carrier;

an elongated driven primary ar, a first primary arm end of said primary arm being pivotally mounted on said carrier by a pivot bearing and a second primary arm end of the first primary arm acting on a window pane;

an elongated secondary arm having a thickness of (b) and being pivotably mounted on the primary arm by a crossed-arm pivot joint, said pivot joint being arranged between the first and second primary arm ends of the primary arm and between a first secondary arm end of the secondary arm acting on the window pane and a second secondary end of the secondary arm acting on a longitudinal guide being rigidly connected with the carrier;

wherein said primary arm being divided into two separate arm parts, a first arm part having a first arm thickness (a) extending between said first primary arm end and said pivot joint and a second arm part extending between said pivot joint and said second primary arm end of said primary arm, said first arm thickness (a) being about 1.77 times the thickness of said secondary arm thickness (b);

wherein said first arm part is provided with a stamped portion with a cylindrical outer circumference extending between a side face of the first arm surrounding said stamped portion and an end face of said stamped portion, said end face being parallel to said side face, said stamped portion having a portion height (d), which correspond to or slightly exceeds the arm thickness (b) of the secondary arm in the region of the pivot joint, said stamped portion extending through a bearing opening provided in said secondary arm, the diameter of said bearing opening being adapted to the diameter of the outer circumference of the stamped portion for pivotal mounting of the secondary arm on said stamped portion and wherein the second arm portion has a flat mounting surface lying flat on said end face of said stamped portion and wherein said first arm portion and said second arm portion are fastened together in the regions of said mounting face and said end face.

9. A crossed-arm window lifter as claimed in claim 8, wherein the secondary arm is provided, around the bearing opening, on at least one of the two sides each facing one of the first and second arm parts, with a small bearing zone provided with grease pockets.

* * * * *